US007357959B2

(12) United States Patent
Bauer

(10) Patent No.: US 7,357,959 B2
(45) Date of Patent: Apr. 15, 2008

(54) METHOD, APPARATUS AND SYSTEM FOR PRODUCING COMPONENTS WITH A PRE-DETERMINED OUTER SURFACE APPEARANCE, ESPECIALLY FOR FRONT PANELS OF KITCHEN UNITS

(76) Inventor: Jörg R. Bauer, Gablerstr. 4, D-88250 Weingarten (DE)

( * ) Notice: Subject to any disclaimer, the term of this patent is extended or adjusted under 35 U.S.C. 154(b) by 0 days.

(21) Appl. No.: 10/312,601

(22) PCT Filed: Jun. 25, 2001

(86) PCT No.: PCT/EP01/07159

§ 371 (c)(1),
(2), (4) Date: Dec. 23, 2002

(87) PCT Pub. No.: WO02/00449

PCT Pub. Date: Jan. 3, 2002

(65) Prior Publication Data

US 2004/0028830 A1 Feb. 12, 2004

(30) Foreign Application Priority Data

Jun. 26, 2000 (DE) ..... 100 31 030

(51) Int. Cl.
*B05D 7/06* (2006.01)

(52) U.S. Cl. ..... 427/262; 427/258; 427/265; 427/280

(58) Field of Classification Search ..... 427/262, 427/267, 280, 256, 261, 421, 426, 407.1, 427/408, 299, 258, 265; 118/305, 315, 314, 118/313, 323, 696, 697
See application file for complete search history.

(56) References Cited

U.S. PATENT DOCUMENTS

| | | | | |
|---|---|---|---|---|
| 1,888,864 | A * | 11/1932 | Mizener | 427/280 |
| 4,849,768 | A * | 7/1989 | Graham | 347/14 |
| 5,252,640 | A * | 10/1993 | Cope | 524/15 |
| 5,645,884 | A | 7/1997 | Harlow, Jr. et al. | |
| 5,750,240 | A * | 5/1998 | Findley et al. | 428/195.1 |
| 5,869,138 | A * | 2/1999 | Nishibori | 427/274 |
| 5,939,143 | A | 8/1999 | Findley et al. | |

(Continued)

FOREIGN PATENT DOCUMENTS

| | | |
|---|---|---|
| DE | 31 07 798 | 9/1982 |

(Continued)

OTHER PUBLICATIONS

J. Steimle Letter of Oct. 14, 2005.

(Continued)

*Primary Examiner*—Fred J. Parker
(74) *Attorney, Agent, or Firm*—Robert W. Becker; Robert W. Becker & Assoc.

(57) ABSTRACT

The invention relates to a method for the production of components with a pre-determined surface appearance, in particular for front panels of kitchen units, whereby the components are printed with a pre-determined pattern by means of a printing method which may be programmed corresponding to the appearance achieved. The invention further relates to a device for the production of said components and a system in which groups of said components are produced.

20 Claims, 6 Drawing Sheets

U.S. PATENT DOCUMENTS

| | | | | |
|---|---|---|---|---|
| 5,954,915 | A * | 9/1999 | Voorhees et al. | 156/362 |
| 6,006,486 | A | 12/1999 | Moriau et al. | |
| 6,050,680 | A * | 4/2000 | Moriyama et al. | 347/85 |
| 6,565,919 | B1 * | 5/2003 | Hansson et al. | 427/203 |
| 6,617,009 | B1 | 9/2003 | Chen et al. | |
| 2001/0028916 | A1 * | 10/2001 | Akahira | 427/8 |
| 2002/0061389 | A1 * | 5/2002 | Brooker et al. | 428/195 |
| 2003/0020767 | A1 | 1/2003 | Saksa | 347/2 |

FOREIGN PATENT DOCUMENTS

| | | | |
|---|---|---|---|
| DE | 195 32 724 | | 3/1997 |
| DE | 19532724 | | 3/1997 |
| EP | 0 791 480 | | 8/1997 |
| EP | 0 931 649 | | 7/1999 |
| FR | 2 706 362 | | 12/1994 |
| GB | 319 006 | | 10/1930 |
| GB | 395014 | | 7/1933 |
| GB | 2 212 761 | * | 8/1989 |
| JP | 46-33238 | * | 9/1971 |
| JP | 71033238 B | * | 9/1971 |
| JP | 77031002 B | * | 8/1977 |
| WO | WO 01/47717 | | 7/2001 |

OTHER PUBLICATIONS

Alno AG Innovations 2006 catalog, pp. 8 and 9 specifically, no date.

* cited by examiner

METHOD, APPARATUS AND SYSTEM FOR PRODUCING COMPONENTS WITH A PRE-DETERMINED OUTER SURFACE APPEARANCE, ESPECIALLY FOR FRONT PANELS OF KITCHEN UNITS

This application is the U.S. national phase of PCT application number PCT/EP01/07159 filed Jun. 25, 2001, which claims priority to German patent application number 100 31 030.3 filed Jun. 26, 2000.

BACKGROUND OF THE INVENTION

The invention relates to a method, an apparatus, and a system for producing components with a predetermined outer surface appearance, in particular front panels of kitchen elements.

A constructional feature of conventional kitchens is the fact that a wide variety of kitchen elements, drawers, cupboards, electrical devices and so forth are provided with front panels which impart a unique and attractive outer appearance to the kitchen. The variety of front panel sizes and the variety of customer-desired outer surfaces, which comprise various types of wood, synthetic material outer surfaces, various colors and patterns, leads to an extraordinarily cost intensive production with a large inventory. For example, front panels are produced from various solid natural woods or with various wood veneers, which are stained in the desired color and the outer surfaces are then sealed.

The object underlying the invention is to ameliorate the above-noted problem.

SUMMARY OF THE INVENTION

In one aspect of the present invention, a method is provided for producing components with a predetermined outer surface appearance, in particular, front panels of kitchen elements. In this method, components are printed to form a predetermined pattern using a printing process programmable with respect to the appearance resulting therefrom.

With the inventive method, components having a wide variety outer appearances can be produced from shaped pieces, whose shape corresponds to the components to be produced, although the printed shaped pieces use the same outer surfaces or shaped pieces which consist of a substantially reduced diversity with respect to the their outer surface material than the printed components to be produced. For example, shaped pieces with only two types of outer surfaces are processed in order to achieve an extraordinarily large variety. The one type of shaped pieces has a synthetic material outer surface and the other type of shaped pieces has a wood veneer outer surface. A wide variety of colors and/or patterns can be printed on the synthetic material outer surface in order to produce an appropriate outer appearance. A wide variety of wood grain patterns can be printed on the wood veneer outer surfaces, which wood grain patterns produce the appearance of a wide variety of wood types with various colorings, without actually having to use the particular wood type. Surprisingly, it has become apparent that a base grain pattern of the veneer outer surface or, as well, of a solid wood outer surface is not averse to printing with other grain patterns and, by appropriately tuning the color intensities, does not detrimentally affect the outer appearance of the imprinted grain pattern. Thus, it is possible with the inventive method to produce an extraordinarily high variety of outer appearances, i.e. to produce appearances in the variety desired by customers with a low variety of raw material pieces.

In preferred embodiments, three dimensional outer surfaces may be printed. In addition or in the alternative, the printing process is performed according to an ink-jet printing process, in which colored liquids of different colors are sprayed from different nozzles.

In accordance with further preferred features, the outer surfaces to be printed are pre-treated such that the outer surfaces absorb colored liquids well, which colored liquids are subject to certain limitations due to the employed printing process such as, for example, an ink jet printing process. In this manner, the outer surfaces to be printed and the colored liquids can be coordinated with one another. For wood outer surfaces, a pre-treatment can also include treating the wood in a predetermined manner in the form of a laser treatment such that its porosity and/or its fluid absorption capacity is tuned to the employed printing process or the wood is provided with a specified base hue.

In accordance with other preferred features, the printed outer surface can be sealed or can be provided with other coatings, which are, for example, mechanically highly resistive, not transparent to UV light, and so forth.

Also disclosed is an apparatus for producing components with a predetermined outer surface appearance, in particular, front panels of kitchen elements. The apparatus preferably comprises a base for receipt of the components, a printing device oppositely disposed to the component and having color spray nozzles for spraying differently colored inks, a transport device for producing a relative movement between the color spray nozzles and the components and a sensor device for sensing the positions of the outer surfaces of the components. An electronic control device controls the operation of the transport device and the printing device such that a predetermined, programmable pattern is printed on the outer surface of the components.

In further embodiments, the distance between the color spray nozzles and the base is preferably adjustable. In addition, the printing device preferably comprises color spray nozzles for printing variously oriented outer surfaces of the component. Moreover, a printing head is preferably longitudinally movable on a support and the support is pivotable about an axis perpendicular to the direction of longitudinal movement of the support. The printing device may also preferably include at least one two-dimensionally pivotable printing head.

A system for producing groups of components having a predetermined appearance, in particular, front panels for a kitchen comprised of elements, preferably comprises an order input for compiling an electronically-processible data record corresponding to a group of ordered components, a shape processing device for producing shaped components from component materials, a finishing device for assembling a group of shaped components that correspond, with respect to their number and their shapes, to the group of ordered components, a printing device for printing the group of shaped components in accordance with the ordered appearance, a product outlet for outputting the group of printed components and an electronic control device for controlling the operation of at least the printing device in accordance with the electronically-processible data record.

With the inventive system, it is possible to achieve, in either a fully automatic or substantially automatic manner and with a very small number of component materials and/or raw materials, an extraordinarily high variety for customers without a cost-intensive inventory storage of substantially finished, and therefore more expensive, parts being necessary. With the inventive system, much more can be produced "just in time" on order in a practical manner.

The invention is employable anywhere in which a high variety of components, with regard to the outer appearance, should be obtained for customers with low costs. The invention is especially advantageously employed with planar components, from which tailored parts with a predetermined shape are first produced; the tailored parts then receive the desired outer surface appearance. One application, for which the invention is particularly well suited, is the furniture industry, in which furniture such as, for example, kitchen furniture, is assembled from planar components which should have different inner and outer appearances, wherein, in particular, the appearance of the outer side thereof must be, to a large degree, customer-specific and of high quality.

The invention is described hereinafter with schematic drawings and with further details.

DESCRIPTION OF THE PREFERRED EMBODIMENTS

Figure 1:
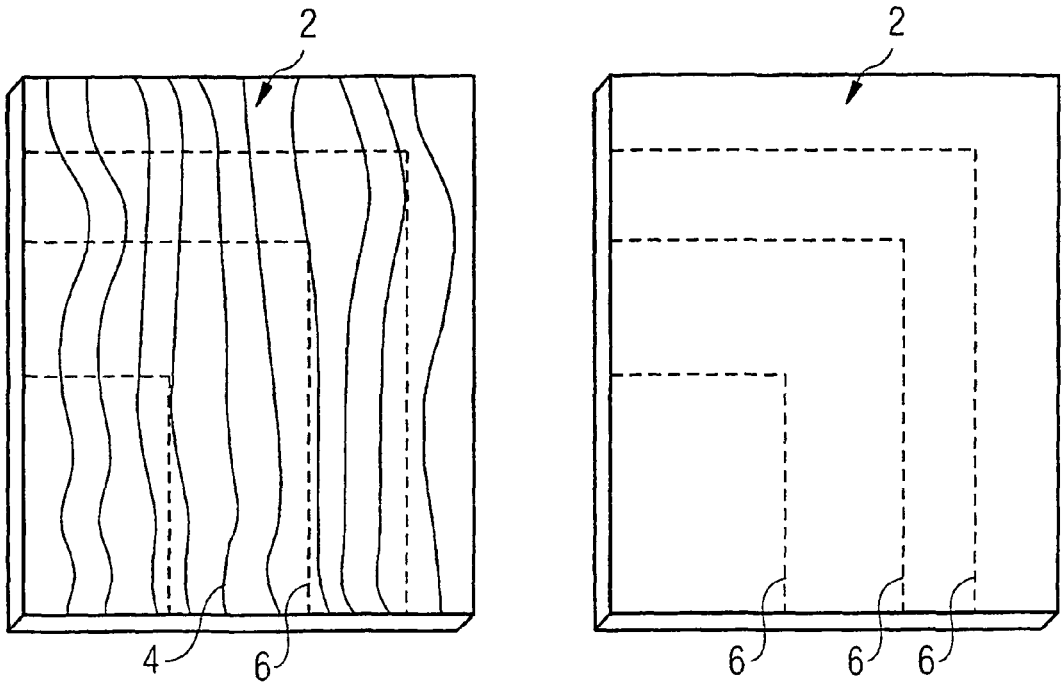
FIG. 1 shows a view of two front panels with differing outer surface structures.

FIG. 1 shows in exemplary manner two front panels 2, wherein the left front panel includes a wood outer surface having a grain pattern 4 and the right front panel includes a homogeneous synthetic material outer surface. The front panels can have a variety of constructions and outer surfaces such as, for example, a fiberboard base body onto which a wood veneer is applied, a synthetic material base body on which the material is bonded or laminated, the outer surface is structured in three dimensional manner, and so forth. The front panels can also be made from solid natural wood.

The broken lines 6 are contour lines to illustrate that the front panels are required in various sizes, wherein non-right angled front panels, round and oval front panels, and so forth also can be provided.

Figure 2A:
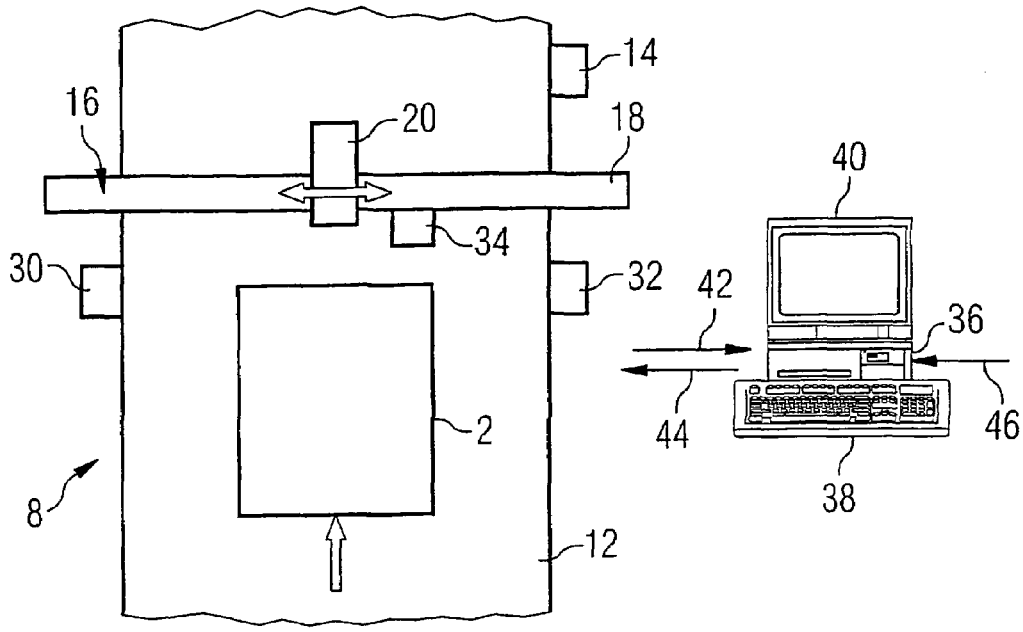
FIG. 2 shows a schematic view of an inventive apparatus.
Figure 2B:
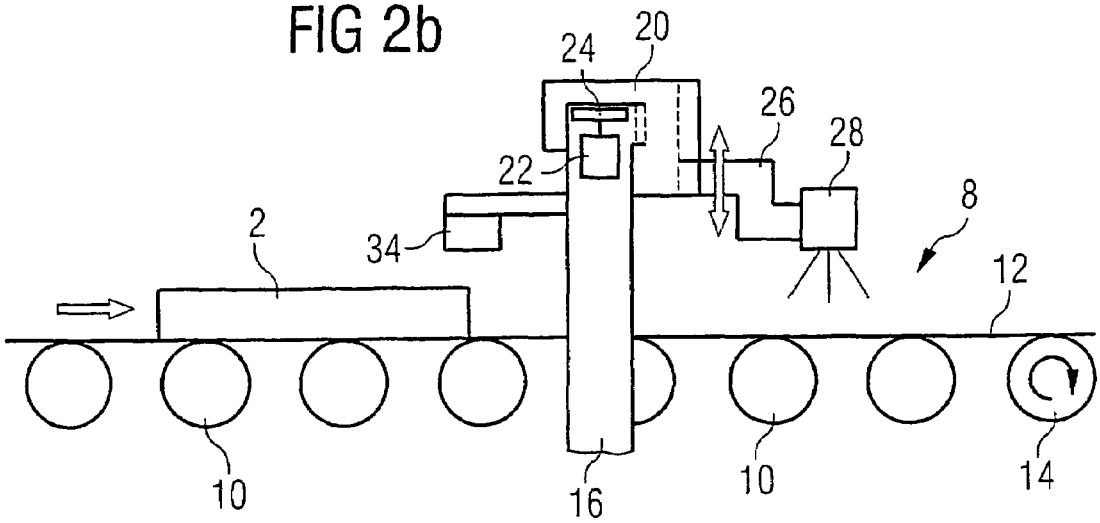

FIG. 2*a* shows in a plan view and FIG. 2*b* shows in a side view an apparatus for applying selected patterns onto a front panel 2.

The front panel 2 is disposed on a transport device 8 which, for example, comprises a transport belt 12 moving over rollers and/or shafts 10; a motor 14 is provided for the driving thereof.

A gantry 16 extends transversely over the transport belt 12; a carriage 20 is movably guided on a crossbeam 18 of the gantry 16 longitudinally to the crossbeam 18. A motor 22 is provided to drive the carriage; a pinion gear 24 of the motor engages with a tooth gear structure of the carriage 20.

A bracket 26 is perpendicularly displaceably guided on the carriage 20 in the direction of the double arrow (FIG. 2B) using a not-illustrated drive; a printing head 28 is affixed to an end of the bracket 26 and is, for example, configured as a type of printing head such as the type used in ink jet printing or bubble-jet printing, wherein colored liquid drops are sprayed from color spray nozzles of the printing head.

Sensors 30, 32, and 34 are provided for detecting the position of the front panel 2, its contour and its thickness, wherein the sensor 30, for example, senses the forward edges of the front panel 2 moving on the transport belt 12, the sensor 32 senses the height of the front panel 2, and the sensor 34, which is supported on the crossbeam 18, senses the side edges of the front panel 2.

The sensors can operate optically, using ultrasound or in another manner and can additionally be movably arranged so that the entire geometry of the outer surface of the front panel 2 can be respectively sensed before the outer surface comes into the area under the printing head 28.

In the figures, the colored liquid reservoir and the colored liquor supply for the printing head 28 is not illustrated; the colored liquid supply can take place, for example, from large reservoir containers that are disposed on the carriage 20.

A control device for controlling the apparatus is provided with a computer 36, a keyboard 38, and a screen 40. It is to be understood that a loudspeaker can also be provided.

The sensors 30, 32, and 34 are connected to the inputs 42 of the computer 36; the drives for two dimensional movement (in the transverse direction to the transport belt 12 and perpendicular to its outer surface) of the printing head 28, the control lines for driving the printing head 28 and, if necessary, the drives for movement of one or more of the sensors 30, 32, and 34, as well as the drive 14 for the transport belt 12, are connected to the outputs 44.

Data are input via a further input 46, the data providing the pattern which is to be produced by the printing head 28. For the formation of this pattern, all degrees of freedom exist, wherein the patterns can be produced by scanning of original images into digital form, can be stored, and then can be applied onto the front panel 2 by appropriate driving of the printing head 28, as well as its movement relative to the front panel 2, together with the controlling of the drive 14. With respect to the data processing, all modern technologies are available such as, for example, those that are conventional with respect to present day photo printing.

The construction and manner of operation of the individual elements of the apparatus are conventionally known and therefore are not elaborated herein.

A front panel 2, which is disposed on the transport belt 12, is recognized by the sensors 30, 32, and 34 based upon the position and size of the front panel, so that the carriage 20 and the perpendicular drive of the bracket 26, as well as the drive of the printing head 28, are controlled by the computer 36 in correspondence with the currently effective pattern data such that the desired pattern is formed. If the entire contour of the front panel 2 is sensed, this serves such that practically no colored liquid is applied to the transport belt 12; the outer surface of the front panel 2, including, as well, its edge regions, is completely printed.

The described apparatus can be modified in numerous ways. For example, if the geometry of the respective front panel is known and the front panel 2 is disposed at a respective reference position on the transport belt 12 and is oriented in a predetermined manner relative to the transport belt 12, it is only necessary to sense the front edge of the front panel 2 and/or the location of the reference position relative to the crossbeam 18, so that the expense for the sensors can be correspondingly reduced. The perpendicular movability of the printing head 28 is required for the reason that, in accordance with the specifications of the printing head 28 and the achievable pattern quality, a predetermined spacing between the color spray nozzles of the printing head 28 and the outer surface of the front panel 2 to be printed is required.

The single movable printing head shown in FIG. 2 having multiple color spray nozzles (not illustrated) for spraying out various colored liquids can, for example, be replaced by nozzle crossbeams arranged one after another in the transport direction, which extend transversely over the transport belt 12 and respectively comprise a row of color spray nozzles that are selectively drivable by the computer 36. The spray nozzles of the individual nozzle crossbeams respectively spray only one color so that any pattern color is producible with three serially arranged nozzle crossbeams.

Figure 3:
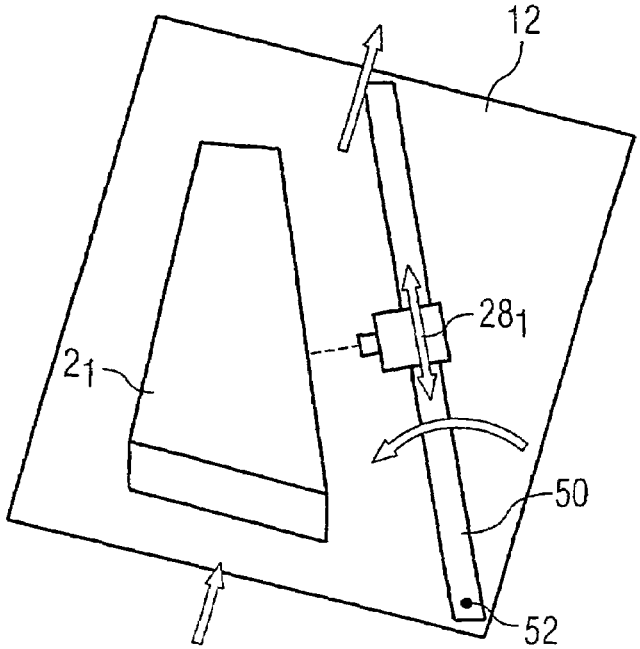
FIG. 3 shows a schematic view of an assembly comprising the inventive apparatus, FIG. 4 shown an example of further assemblies comprising the inventive apparatus.

FIG. 3 shows, in perspective view, an advantageous detail of a printing device, which is additionally provided if necessary. In this printing device, the printing head 28 is guided in a longitudinally moveable manner on a support 50 in the direction of the double arrows and the support 50 is pivotable about an axis 52 perpendicular to the direction of the double arrow. Additionally, the support 50 can be adjustable in the height direction or the printing head 28 can be adjustable in the height direction relative to the support 50.

With the apparatus, it is possible, as can be directly seen, to print side surfaces of the front panel 2 even if the side surfaces are inclined relative to the transport direction of the transport belt 12.

Figure 4:
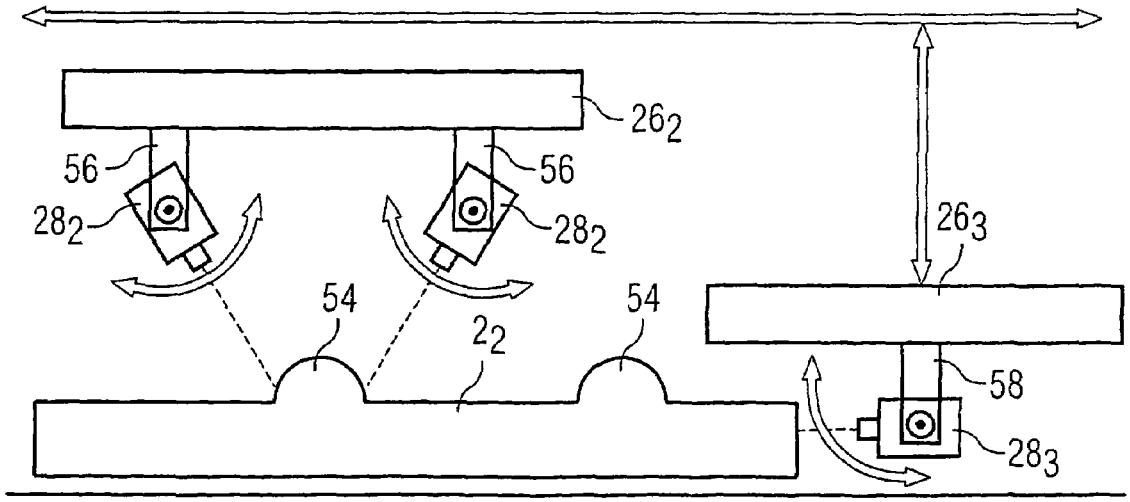

FIG. 4 shows further details of possible embodiments of the printing device. Printing heads $\mathbf{28}_2$ are pivotable relative to a bracket $\mathbf{26}_2$ by means of a not-illustrated drive, such that the projections 54 formed on the front panel 22 can be printed. The bracket $\mathbf{26}_2$ can also be displaceably movable in the vertical direction and the printing heads $\mathbf{28}_2$ can, for example, be pivotable about a vertical axis by means of a suitable bearing of the support arm 56 on the bracket $\mathbf{26}_2$. By means of the thus produced kinematic possibilities, it is possible to print the projections 54 in a manner such that the color spray nozzles of the printing heads $\mathbf{28}_2$ are each located at a predetermined spacing from the outer surface and oriented perpendicular to the outer surface direction, whereby a high quality pattern can be produced.

The printing head $\mathbf{28}_3$, which is further illustrated in FIG. 4, is movable as a whole such that the side surfaces of the front panel $\mathbf{2}_2$ are printable.

Figure 5:
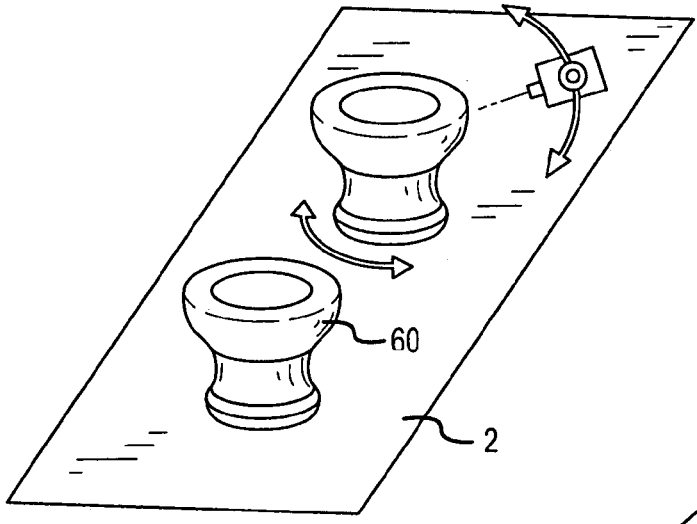
FIG. 5 shows a detail of the apparatus for printing operation knobs.

As can be directly seen in the preceding drawings, each outer surface contour of a front panel 2, including as well, for example, control knobs 60 provided on a front panel 2 according to FIG. 5, can be printed with a printing head 28, which is pivotably arranged about a vertical and a horizontal axis on a bracket 26 (FIG. 2) that is movable vertically and in the transverse direction of the transport belt 12, operating in cooperation with a forward movement and a backward movement of the transport belt 12.

Figure 6:
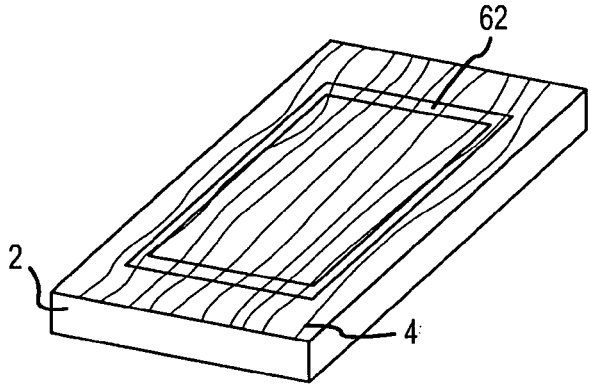
FIG. 6 shows a front panel provided with a decor.

FIG. 6 shows an example of a decor and/or a pattern, 62, which is applied onto an outer surface of a front panel 2, the outer surface being provided with a grain pattern 4. The grain pattern 4, which can be provided by the wood itself and/or is also applied by printing, can be differently accentuated according to a homogeneous contrasting color, in which the outer surface is sprayed and/or printed, wherein a rectangular border is additionally applied as a decor and/or as a pattern in the illustrated example.

Figure 7:
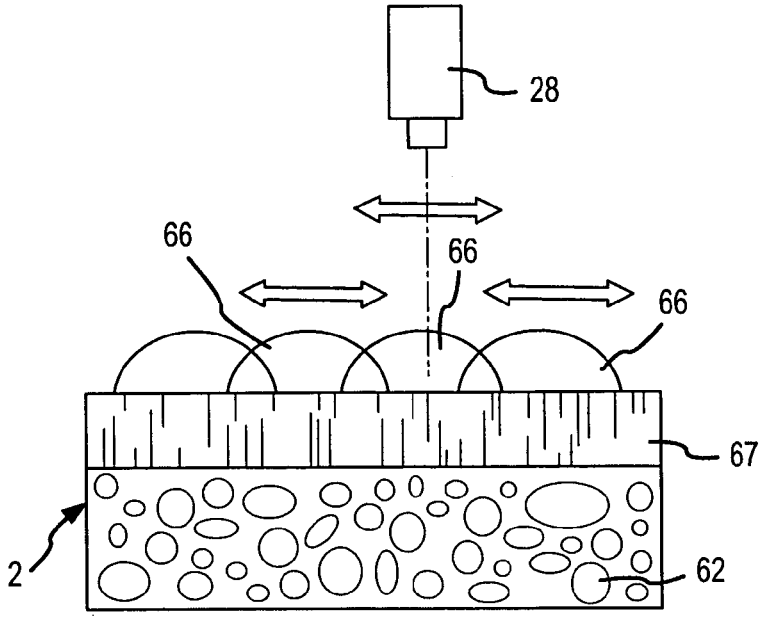
FIG. 7 shows a sectional view through a front panel for illustrating the printing.

FIG. 7 shows a front panel, which includes a base body 62, for example, made from fiberboard, on which a veneer 67 made from soft and/or absorbent, wood is mounted. If liquid drops 66 are applied to this type of an absorbent outer surface, similar to fibrous or moist paper, these drops spread sideways and flow into one another, whereby a very pleasing pattern, from an optical perspective, can be produced, if the edge areas of the differently colored liquid drops 66 run into each other.

The amounts of the colored liquids of the individual liquid drops, which run into one another, can be influenced by the volume of the liquid drops and the nature of the outer surface.

Figure 8:
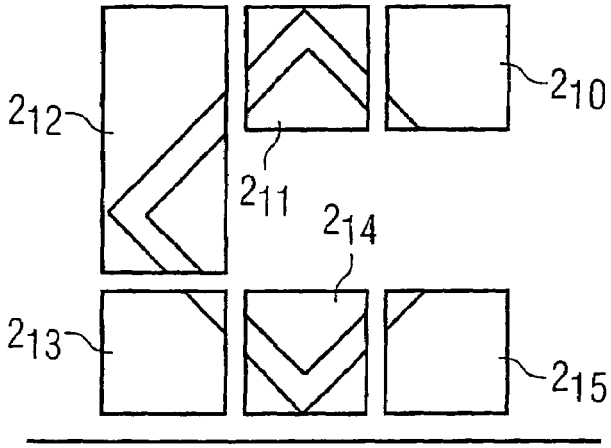
FIG. 8 shows a group of front panels.
Figure 9:
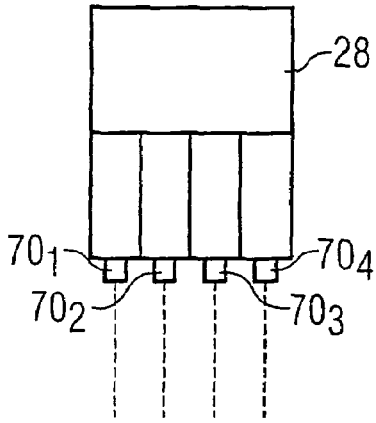
FIG. 9 shows a schematic sectional view through a printing head.

FIG. 8 shows an example, in which an overall pattern and/or an overall impression can be produced by appropriate printing of individual front panels $\mathbf{2}_{10}$ through $\mathbf{2}_{15}$. In accordance with FIG. 9, different color spray nozzles $\mathbf{70}_1$ to $\mathbf{70}_4$ charged with different-colored liquids can be provided in a printing head 28, wherein, for example, the printing heads $\mathbf{70}_1$, $\mathbf{70}_2$, and $\mathbf{70}_3$, are charged with colors which, when combined, produce the color black and the printing head $\mathbf{70}_4$ is charged with a black-colored color liquid.

Figure 10:
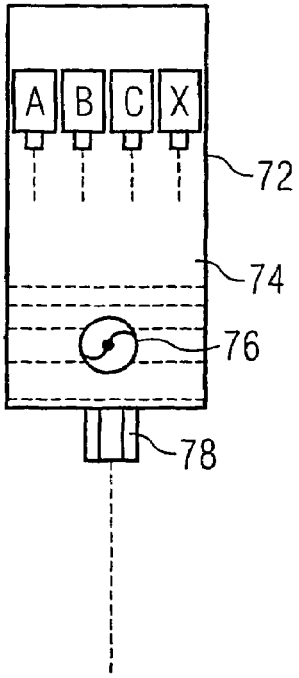
FIG. 10 shows a schematic sectional view through a modified embodiment of a printing head.

FIG. 10 shows an embodiment of a printing head 72 which comprises four different printing heads, A, B, C, and X, wherein the printing heads A, B, C are charged with differently-colored liquids and the printing head X is charged with a rinsing liquid. The printing heads A, B, C spray the respective colored liquids into an intermediate container 74, which is provided with a stirrer 76, and from which an additional printing head 78 is charged.

With the assembled printing head 72, the following is achieved:

By appropriately driving the printing heads A, B, C, every mixed color can be produced in the intermediate container 74 in a programmable manner from the three different colored liquids, the homogeneity of the mixed color being guaranteed by stirrer 76. In this manner, the colored liquid of each desired color can be extensively and homogeneously sprayed from the printing head 78 and applied onto an outer surface.

Figure 11:
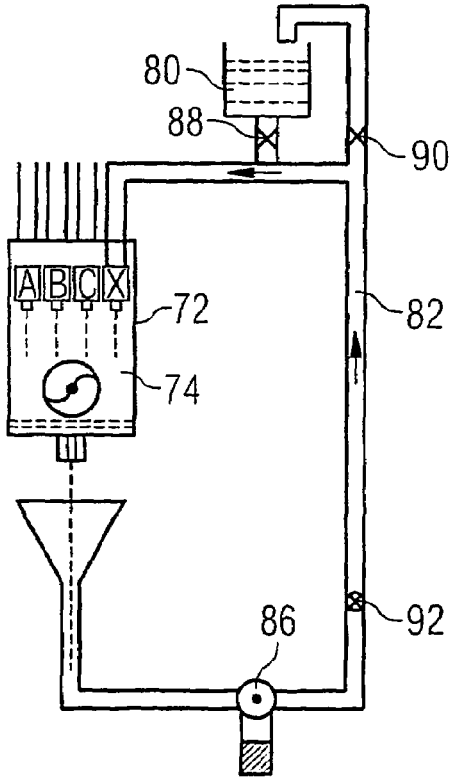
FIG. 11 shows a view of the printing head shown in FIG. 10 in a rinsing device and FIG. 12 shows a system for the production of front panels belonging to an ordered kitchen.

FIG. 11 shows the printing head 72 of FIG. 10 during a rinsing process, when a color change is required. After the programmed liquid volume of the intermediate container 74 has been substantially sprayed out, a rinsing liquid from a supply container 80 is sprayed out of the printing head X into the intermediate container 74 and the rinsing liquid is supplied into a circulation loop 82. The rinsing liquid can be filtered at 86, if the colored liquid is a pigmented colored liquid, and can then repeatedly flow through the intermediate container 74 until no more color residues are present, and thereafter can be again supplied to the supply container 80. The reference numerals 88 and 90 denote valves; reference numeral 92 denotes a pump. With the arrangement of FIG. 11, various homogeneous colors can be sprayed in an environmentally friendly manner with low color liquid losses.

Preferably, a coating layer covers the previously described printing of the outer surfaces of the front panels 2, in which the outer surface, which is formed in a predetermined pattern and/or with a predetermined background color using colored liquid, is provided with a protective coating, whereby this protective coating is applied, for example, as a film or as a one or two component synthetic resin or a natural resin. The protective coating, which is preferably transparent, makes the outer surface durable, chemically resistive, and scratch resistant. In addition, it reduces the requirements for the UV resistance capability of the utilized colored liquids and/or inks, with which the printing is effected. The protective coating can be formed by spraying, rolling, or also by other known ways.

The described method can be modified in numerous ways. The printing is not required to be effected according to the ink jet process. The coloring and/or pattern formation on the outer surfaces can be effected with any other process, which is preferably programmable, so that a high degree of flexibility is provided.

Figure 12:
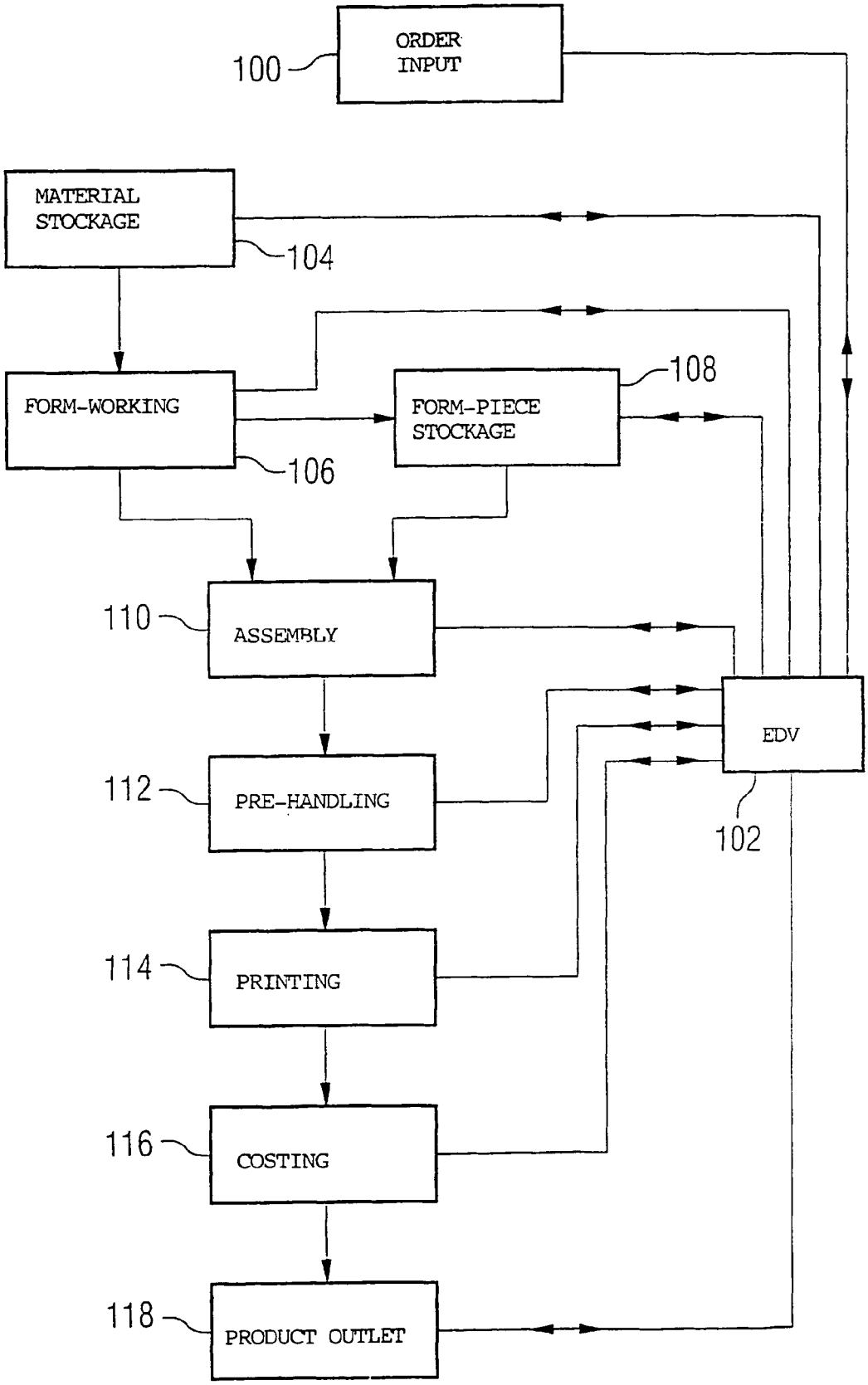

FIG. 12 schematically shows the structure of an entire system for producing groups of front panels which are required for a kitchen.

Reference numeral 100 refers to the order input, in which orders for a kitchen are input in a wide variety of ways. An ordered kitchen is characterized by the nature and number of its components, such as cupboards, shelves, electrical devices, and so forth, which are all finished with front panels on the visible side; the front panels have a specific decor that distinguishes itself, for example, by the outer surface material, the base color, and the pattern with its respective colors.

In response to the receipt of an ordered kitchen, an electronically-processible data record is compiled in the order input 100 for a group of front panels, which data record requires the group for an ordered kitchen and which data record is complied in view of the outer surface characteristics and dimensions of the front panels. Depending on whether the required front panels are already available in a finished condition in an inventory 102 or must be produced in a customizing device 104 with the respective dimensions, the ordered data record goes through the inventory 102 or the customizing device 104.

The data record complied in the order input 100 is supplied to a control device 102 that operates using electronic data processing.

Pre-prepared raw material boards with the required diversity of outer surfaces, e.g., synthetic material panels and/or panels with wood veneers, are stored in a material inventory 104.

A shape processing device 106 follows the material inventory 104; in the shape processing device 106, the unfinished panels taken from the material inventory 104 can be cut with cutting devices controlled in conventional numerical control manner or other cutting devices; shaped panels and/or shaped pieces with predetermined dimensions can be produced from the cut panels. The shape processing device 106 is followed by a shaped piece inventory 108 in which, in particular, frequently required pre-finished shaped pieces are stored.

Further, a finishing device 110 follows the shape processing device 106; in the finishing device 110, groups of shaped pieces, which belong, for example, to a single order, are assembled together with one another. These groups can be arranged in several different ways, for example, immediately after the order or thereafter, whether they require predetermined special outer surface treatments, which are first possible after alteration thereof. Various outer surfaces can belong to a single order.

The finishing device 110 is followed by a pre-treatment device 112, in which the shaped pieces assembled in the finishing device are pre-treated in a predetermined manner; for example, they are provided with a primer coat, an edge veneer is mounted, an edge protector is mounted, and so forth.

The pre-treatment device 112 is followed by a printing device 114 which, for example, is configured in a manner similar to the printing device described in the preceding figures. A coating device 116 follows the printing device 114, in which the printed and, if necessary low resistance, outer surfaces are coated, for example, with clear enamel which is mechanically especially resistant, not chemically corrodible and/or does not permit UV light to pass through. A product outlet 118 follows the coating device 116, in which the finished components are available for further processing into a complete kitchen, a furniture piece, and so forth.

In FIG. 12, double arrows indicate the respective flow of material. The connections between the electronic control device 102 and the individual stations are shown by broken lines, wherein the double arrows respectively indicate that bi-directional data communication occurs.

In the individual devices and/or stations, the construction of the operation devices, transport devices, shelf inventories, and so forth, can be known, which devices are controlled by the control device 102 in accordance with the respective data record.

It is assumed that a data record corresponding to an ordered kitchen is compiled in the order input 100. The electronic control device then inquires in the shaped piece inventory 108 whether corresponding shaped pieces are already pre-finished. The available shaped pieces are delivered to the finishing device 110. The not yet finished shaped pieces are processed from the raw material boards in the shaped processing device 106 and are delivered to the finishing device 110. Thereafter, the components pass through the pre-treatment, the printing, and the coating, in order to then be available in the shipping area 118. The pre-treatment device 112 and the coating device 116 can basically be configured in a manner similar to the printing device, i.e., they comprise a transport belt or other transport device, on which they are supplied to the respective working station, wherein the respective position, geometry, and so forth thereof is sensed by position sensors.

As can be directly seen from the foregoing, the inventive system makes possible, with a very small stock inventory (material inventory 104; the shaped piece inventory 108 is not absolutely necessary), a need-based, fully-automatic production of component groups corresponding to an order input or, in case individual handles will be affixed manually, a substantially automatic production. It is to be understood that additional fully-automatic working stations could follow the product outlet 118, in which complete furniture pieces are assembled from the pre-finished components, whose outer surfaces are already complete.

The described system can be modified in numerous ways. For example, the pre-treatment device 112 and the coating device 116 are not necessary. The printing device 114 can work in accordance with various processes. A further working station can follow the finishing device 110 and/or the pre-treatment device 112, in which assembled components are produced from the not yet printed components, which assembled components are then printed. The construction of the shape processing device 106 can be complex so that not only components are cut from the raw material boards, but also components are formed, for example, with three-dimensional ornamentation and so forth.

With the illustrated system, replacement pieces for furniture pieces such as, for example, replacement walls for front panels of a kitchen, can also be produced, as the system operates with very good reproducibility due to the advantageously programmable printing 114 and, as may optionally be provided, with the enhancements of the pre-treatment and the coating. The system is extraordinarily flexible and is suitable with respect to the illustrated structural configurations for deployment for the production, especially, of furniture. The individual stations which are networked to the data processing system can also be networked as desired such as, for example, with remote order inputs communicating via different communication ways.

| Reference Numeral List | |
|---|---|
| 2 | front panel |
| 4 | grain pattern |
| 6 | contour lines |
| 8 | transport device |
| 10 | shaft |
| 12 | transport belt |
| 14 | motor |
| 16 | gantry |
| 18 | crossbeam |
| 20 | carriage |
| 22 | motor |
| 24 | pinion |
| 26 | bracket |
| 28 | printing head |
| 30 | sensor |
| 34 | sensor |
| 36 | computer |
| 38 | keyboard |
| 40 | screen |
| 42 | inputs |
| 44 | outputs |
| 50 | support |
| 52 | axis |
| 54 | projection |
| 56 | support arm |
| 58 | support arm |
| 60 | control knob |
| 62 | pattern |
| 64 | base body |
| 66 | liquor drops |
| 70 | color spray nozzle |
| 72 | printing head |
| 74 | intermediate container |
| 76 | stirrer |
| 78 | printing head |
| 80 | supply container |
| 82 | circulation loop |
| 86 | filter |
| 88 | valve |
| 90 | valve |
| 92 | pump |
| 100 | order input |
| 102 | electronic control device |
| 106 | shape processing device |
| 108 | shape piece inventory |
| 110 | finishing device |
| 112 | pre-treatment device |
| 114 | printing device |
| 116 | coating device |
| 118 | product outlet |

The invention claimed is:

1. A method for printing a rigid component comprising a veneer having a solid natural wood outer surface that is mounted onto a base body, the method comprising:

ink jet printing a plurality of differently-colored inks from a plurality of different nozzles onto said veneer according to a program configured to ink jet print a predetermined wood appearance comprising a predetermined wood grain pattern and a predetermined background color, wherein the plurality of colored inks and the veneer possess the following properties and the ink jet printing is performed such that:

(i) the colored inks are absorbed by the veneer, (ii) edge regions of neighboring sprayed droplets of differently-colored inks flow into one another while being absorbed by the veneer, and (iii) after ink jet printing and absorption of the colored inks, the resulting visual appearance of the veneer is formed by a combination of the imprinted predetermined wood appearance and the natural appearance of the veneer, such that said resulting visual appearance of the imprinted veneer is different from both the predetermined wood appearance and the natural appearance of the veneer.

2. A method according to claim 1, further comprising:

scanning an original image into digital form, storing the scanned image, and applying the scanned image according to said ink jet printing step.

3. A method according to claim 2, wherein the original image is a wood outer surface appearance.

4. A method according to claim 3, further comprising:

differently accentuating the printed wood grain pattern by changing the intensity of the predetermined background color that is printed with the wood grain pattern.

5. A method according to claim 4, further comprising:

selecting the predetermined wood appearance from a plurality of predetermined wood appearances stored in a computer, the selected predetermined wood appearance differing from the natural appearance of said veneer.

6. A method according to claim 5, further comprising:

ink jet printing at least one three-dimensional outer surface defined on the rigid component.

7. A method according to claim 6, wherein a predetermined spacing is maintained between an ink jet print head comprising said nozzles and the three-dimensional outer surface while the three-dimensional outer surface is being ink jet printed.

8. A method according to claim 7, wherein the rigid component is a front panel of a kitchen cupboard.

9. A method according to claim 8, further comprising:

supporting the rigid component on a base during the ink jet printing step, actuating a transport device to move the color spray nozzles relative to the rigid component during the ink jet printing step, detecting at least one outer surface of the rigid component using at least one sensor, and controlling the operation of the transport device and the ink jet printer using information received from the at least one sensor such that the predetermined wood appearance is ink jet printed on the veneer.

10. A method according to claim 9, further comprising:

adjusting the distance between the color spray nozzles and the base during the ink jet printing step.

11. A method according to claim 10, wherein the ink jet printing step further comprises:

longitudinally moving at least one printing head mounted on a support coupled to the base, and pivoting the support about an axis perpendicular to the direction of longitudinal movement of the support.

12. A method according to claim 11, further comprising:
two-dimensionally pivoting the at least one printing head during the ink jet printing step.

13. A method according to claim 12, further comprising:
generating an input order by compiling an electronically processible data record corresponding to a group of components that have been ordered, the order input including information concerning the desired wood appearance of components to be printed, and
cutting raw material boards to form shaped pieces corresponding to the ordered group of components, the shaped respectively comprising the wood veneer mounted on a base body, and
wherein the ink jet printer is programmably controlled so as to print the shaped corresponding to the ordered group of components in accordance with the electronically processible data record, thereby producing the printed components having the desired wood appearance.

14. A method for printing a wood veneer mounted on a base body made of a synthetic material or fiberboard, the method comprising:
selecting a predetermined type of wood appearance, which has a predetermined wood grain pattern and a background color, from a plurality of predetermined types of wood appearances, each of which has a predetermined wood grain pattern and background color, stored in a computer, the wood grain pattern and background color of the selected predetermined type of wood appearance differing from the natural wood grain pattern and natural background color of said veneer, and
ink jet printing a plurality of differently colored inks on said veneer according to a program configured to print the selected predetermined type of wood appearance, wherein the plurality of colored inks and the veneer possess the properties that:
(i) the colored inks are absorbable by the veneer, and
(ii) edge regions of neighboring sprayed droplets of differently colored inks flow into one another while being absorbed by the veneer,
such that said resulting visual appearance of the wood grain pattern of the imprinted veneer is different from both the selected predetermined type of wood appearance and the natural wood grain pattern and natural background color of the veneer.

15. A method according to claim 14, further comprising:
scanning an original image into digital form, the original image being a wood outer surface appearance,
storing the scanned image, and
applying the scanned image according to said ink jet printing step.

16. A method according to claim 14, further comprising:
differently accentuating the printed wood grain pattern by changing the intensity of the predetermined background color that is printed with the wood grain pattern.

17. A method according to claim 14, further comprising:
ink jet printing at least one three-dimensional outer surface defined on the rigid component, wherein a predetermined spacing is maintained between an ink jet print head comprising said nozzles and the three-dimensional outer surface while the three-dimensional outer surface is being ink jet printed.

18. A method according to claim 14, wherein the rigid component is a front panel of a kitchen cupboard.

19. A method for printing a rigid component comprising a veneer having a solid natural wood outer surface that is mounted onto a base body, the method comprising:
scanning an original image of a wood cuter appearance into digital form,
storing the scanned image,
applying the scanned image to the veneer by ink jet printing a plurality of differently-colored inks from a plurality of different nozzles onto said veneer according to a program configured to ink jet print the stored wood outer appearance comprising a predetermined wood grain pattern and a predetermined background color, wherein the plurality of colored inks and the veneer possess the following properties and the ink jet printing is performed such that:
(i) the colored inks are absorbed by the veneer,
(ii) edge regions of neighboring sprayed droplets of differently-colored inks flow into one another while being absorbed by the veneer, and
(iii) after ink jet printing and absorption of the colored inks, the resulting visual appearance of the veneer is formed by a combination of the imprinted predetermined wood appearance and the natural appearance of the veneer,
such that said resulting visual appearance of the imprinted veneer is different from both the predetermined wood appearance and the natural appearance of the veneer.

20. A method according to claim 19, further comprising:
differently accentuating the printed wood grain pattern by changing the intensity of the predetermined background color that is printed with the wood grain pattern.

* * * * *